US007683846B2

(12) United States Patent
Yoon et al.

(10) Patent No.: US 7,683,846 B2
(45) Date of Patent: Mar. 23, 2010

(54) RECEIVER SYSTEM FOR ULTRA WIDEBAND

(75) Inventors: Ick-Jae Yoon, Seoul (KR); SeongSoo Lee, Suwon-si (KR); Young Joong Yoon, Seoul (KR); Young-Hwan Kim, Hwaseong-si (KR); Young-Eil Kim, Suwon-si (KR); Hyungrak Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 922 days.

(21) Appl. No.: 11/477,616

(22) Filed: Jun. 30, 2006

(65) Prior Publication Data

US 2007/0182653 A1 Aug. 9, 2007

(30) Foreign Application Priority Data

Feb. 3, 2006 (KR) ..... 10-2006-0010872

(51) Int. Cl.
*H01Q 13/10* (2006.01)

(52) U.S. Cl. ..... 343/767; 343/829; 343/846; 343/700 MS

(58) Field of Classification Search ..... None
See application file for complete search history.

(56) References Cited

U.S. PATENT DOCUMENTS

| | | | | |
|---|---|---|---|---|
| 7,057,568 | B2 * | 6/2006 | Louzir et al. | 343/767 |
| 2004/0196188 | A1 * | 10/2004 | Yeh | 343/700 MS |
| 2005/0156788 | A1 * | 7/2005 | Lin | 343/700 MS |
| 2005/0285809 | A1 * | 12/2005 | Louzir et al. | 343/770 |

OTHER PUBLICATIONS

Ick-Jae Yoon, "UWB RF Receiver Front-End With Band-Notch Characteristic of 5 GHz WLAN", A Masters Thesis Submitted to the Graduate School of Yonsei University.

* cited by examiner

*Primary Examiner*—Trinh V Dinh
(74) *Attorney, Agent, or Firm*—Sughrue Mion, PLLC

(57) ABSTRACT

An ultra wide band receiver system comprising a ultra wide band antenna and an active circuit. The ultra wide band antenna including a power feed operable to receive electromagnetic energy. The ultra wide band antenna further includes a radiator operable to be excited by the electromagnetic energy fed through the power feed to radiate an electromagnetic wave. The radiator has a metal layer. The active circuit includes a pair of parallel coupled lines arranged on a first side of the radiator. The pair of parallel coupled lines is operable to block DC current. The active circuit further includes at least one defected ground structure formed on a second side of the radiator. The defected ground structure is formed on an etched out part of the metal layer.

23 Claims, 7 Drawing Sheets

RECEIVER SYSTEM FOR ULTRA WIDEBAND

CROSS-REFERENCE TO RELATED APPLICATION

This application claims the benefit of Korean Patent Application No. 2006-10872, filed Feb. 3, 2006, in the Korean Intellectual Property Office, the entire contents of which are incorporated herein by reference.

BACKGROUND OF THE INVENTION

1. Field of the Invention

The present invention generally relates to a receiver system for ultra wideband (UWB). More particularly, the present invention relates to a UWB receiver system capable of completely removing interference by WLAN band signal.

2. Description of the Prior Art

UWB communications utilizes wide frequency band and thus enabled high-speed data transmission with very low power consumption. The UWB communications use frequency band of 3.1~10.6 GHz, and HIPERLAN/2 or IEEE 802.11a, the WLAN communication service standards. Particularly a frequency band of 5.15~5.825 GHz is used. Because power at WLAN band is higher than that of UWB communication system by more than 70 dB, the UWB communication system may suffer electromagnetic interference by WLAN signal. Accordingly, ways to remove WLAN frequency signals from the UWB communication signals have been conventionally studied and suggested. One of the conventional suggestions uses a band stop filter (BSF) at the end of the RF receiver system.

FIG. 1 is a block diagram of the structure of a RF receiver system using an UWB antenna. Referring to FIG. 1, a conventional receiver system includes a UWB antenna 1, a filter 2, and an amplifier 3.

The UWB antenna 1 receives signals of the frequency band of 3.1~10.6 GHz.

The filter 2 operates to remove signals of 5.15~5.825 GHz from the signals received at the UWB antenna 1. The filter 2 includes a BSF (band stop filter) which does not let the signals of a predetermined frequency band pass through, thereby filtering off the predetermined frequency band.

The amplifier 3 operates to amplify received signals and output the amplified signals at the rear end.

In the conventional receiver system, the UWB antenna 1 and the filter 2 are respectively implemented as independent circuits. Accordingly, the size of the receiver system is increased. Additionally, because the receiver system has a plurality of components significant power loss occurs. Further, the system has a complicated structure. Additionally, although the conventional filter 2 may remove a part of the WLAN signals, the power of 70 dB in the WLAN band cannot be completely controlled.

Accordingly, techniques for removing WLAN band power completely from the UWB communication, and thus removing interference by the WLAN signals, is required.

SUMMARY OF THE INVENTION

The present invention seeks to overcome some of the problems of the related art. Accordingly, the present invention provides a receiver system for ultra wideband (UWB), which is capable of completely removing interference by WLAN signals. The present invention provides an UWB (ultra wide band) receiver system comprising an ultra wide band antenna and an active circuit. The ultra wide band antenna includes a power feed operable to receive electromagnetic energy. The ultra wide band antenna further includes a radiator operable to be excited by the electromagnetic energy fed through the power feed to radiate an electromagnetic wave. The radiator has a metal layer. The active circuit includes a pair of parallel coupled lines arranged on a first side of the radiator. The pair of parallel coupled lines is operable to block DC current. The active circuit further includes at least one defected ground structure formed on a second side of the radiator. The defected ground structure is formed on an etched out part of the metal layer.

The radiator comprises a substrate; a metal layer bonded onto the substrate; and a taper type slot formed by removing one side of the metal layer to a predetermined length, with gradually widening in the radiating direction of the electromagnetic wave, the taper type slot dividing the metal layer into two parts.

A stub may be provided for blocking signal transmission and reception at a frequency band, the stub being notched in one side of the metal area adjoining the taper type slot. The stub is substantially parallel with an electric field of the electromagnetic wave.

The stub comprises a first and a second stubs formed on a metal layer adjoining the taper type slot, each being open on one end toward the taper type slot, the first and the second stubs having a length of $\lambda/4$ of the center frequency signal of the predetermined frequency band.

The power feed comprises a first power feed part formed on a lower surface of the substrate to receive a supply of the electromagnetic energy; and a second power feed part having an etched area of a predetermined shape at a leading end of the taper type slot, the second power feed part for coupling the electromagnetic energy.

The first and the second power feed parts may be formed in a multi-arm structure which has a plurality of radially-arranged arms.

Each of the DGSs comprises an etched area in a part of the metal layer, and a metal area formed within the etched area.

A pair of DGSs may be provided to correspond in position to ends of the first and the second coupled lines, respectively, and are formed across the width of the first and the second coupled lines, respectively.

The etched area may be formed around the metal area.

A metal plate type of bridge may be formed on one side of the metal area to electrically connect the metal area and the metal layer.

The bridge may be formed longitudinally in the middle of one side of each of the DGSs.

The bridge of one DGS may be arranged to face the bridge of another DGS.

The first and the second coupled lines may be formed at a predetermined gap from each other, and the bridge of each of the DGSs is aligned with the predetermined gap.

The predetermined gap may be equal to the width of the bridge of each of the DGSs.

The length of the etched area as extended, but excluding the bridge, may correspond to $\lambda/2$ of the stop band.

The etched area may have at least one of rectangle, square, ellipse, circle, diamond, zigzag, and spiral shapes.

The metal area within the etched area may have the same shape as the etched area.

The widths and the lengths of the etched area and metal area may be determined according to the stop band and the bandwidth.

The metal area may be formed to the other side of the etched area where the bridge is not formed such that the one side having the bridge is wider than the other side without it.

The active circuit comprises a low noise amplifier (LNA).

According to one aspect of the present invention, an active circuit comprising a pair of coupled lines parallel arranged on one side of a dielectric body to block DC current; and one or more DGSs (defected ground structure) formed on the other side of the dielectric body to correspond to the coupled lines, and comprising an etched area formed by etching away a part of a ground surface which is attached to the dielectric body, and a metal area formed within the etched area.

BRIEF DESCRIPTION OF THE DRAWINGS

The features of the present invention will become more apparent by describing in detail embodiments thereof with reference to the attached drawings, in which.

DESCRIPTION OF THE EXEMPLARY EMBODIMENTS

Hereinafter, the present invention will be described in detail with reference to the drawings.

Figure 1:
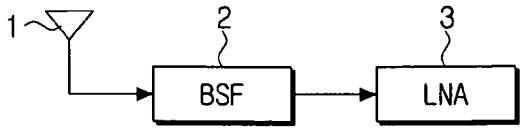
FIG. 1 (PRIOR ART)
FIG. 1 is a block diagram showing the structure of a RF receiver system using a conventional UWB antenna.
Figure 2A:
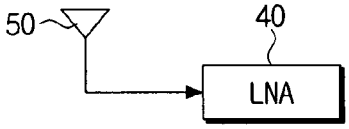
FIG. 2A is a block diagram of a receiving end of a receiver system for UWB according to an embodiment of the present invention.
Figure 2B:
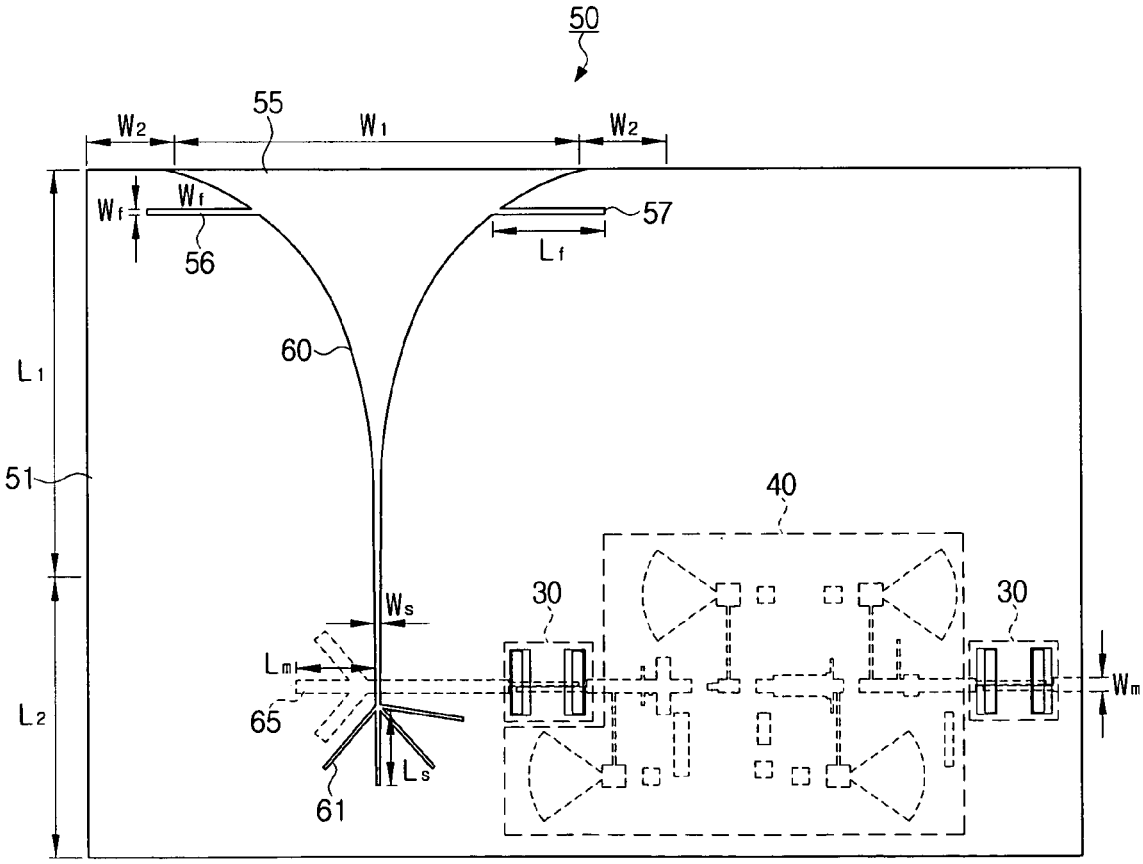
FIG. 2B is a view showing the structure of the receiving end of the UWB receiver system of FIG. 2A.

FIG. 2A is a block diagram of a receiving end of a receiver system for UWB according to an embodiment of the present invention, and FIG. 2B is a view showing the structure of the receiving end of the UWB receiver system of FIG. 2A.

Referring to FIG. 2A, a receiving end of a UWB receiver system includes a UWB antenna 50 and a LNA (low noise amplifier) 40.

As shown in FIG. 2B, the UWB antenna 50 includes a substrate 55, a metal layer 51, a first and a second stubs 56 and 57, a first power feed part 65, a second power feed part 61, and a taper type slot 60.

The substrate 55 is formed of a dielectric material, and the metal layer 51 is bonded onto the upper surface of the substrate 55. The taper type slot 60 is formed by etching away a part of the metal layer 51, and divides the metal layer 51 into two parts. The taper type slot 60 is formed such that the width gradually increases toward the edge of the substrate 55. The taper type slot 60 forms a radiation body which radiates electromagnetic waves in a predetermined direction.

The metal layer 51 at the leading end of the taper type slot 60 is etched to form the second power feed part 61. The second power feed part 61 includes a plurality of arms extending in a radial manner. The second power feed part 61 couples electromagnetic energy provided by the first power feed part 65 and transmits it to the taper type slot 60.

The first power feed part 65 receives the supply of external electromagnetic energy and transmits it to the metal layer 51 and the taper type slot 60. The first power feed part 65 is formed of a predetermined conductive material and attached to the lower surface of the substrate 55. The first power feed part 65 is connected with an external terminal and thus receives supply of electromagnetic energy. The first power feed part 65 has a multi-arm structure, which means it has a plurality of extending arms.

The electromagnetic energy transmitted to the taper type slot 60 is converted into aerial electromagnetic waves at one end opposite to the other end on which the second power feed part 61 of the taper type slot 60 is formed, and then radiated. In other words, the electromagnetic waves are radiated in the direction from the narrow end to the wide end of the taper type slot 60.

The metal layer 51 is notched at the wide end of the taper type slot 60 to form the first and the second stubs 56 and 57. The first and the second stubs 56 and 57 are formed opposite to each other with reference to the taper type slot 60 on the metal layer 51. The first and the second stubs 56 and 57 are formed parallel with respect to the direction of the electric field of the electromagnetic waves which are formed at the taper type slot 60. The lengths of the first and the second stubs 56 and 57 are $\lambda/4$ and $\lambda/4$, respectively. The first and the second stubs 56 and 57 block the electromagnetic energy of a predetermined frequency band at the taper type slot 60, and thus removes the signal of corresponding frequency band.

Figure 3:
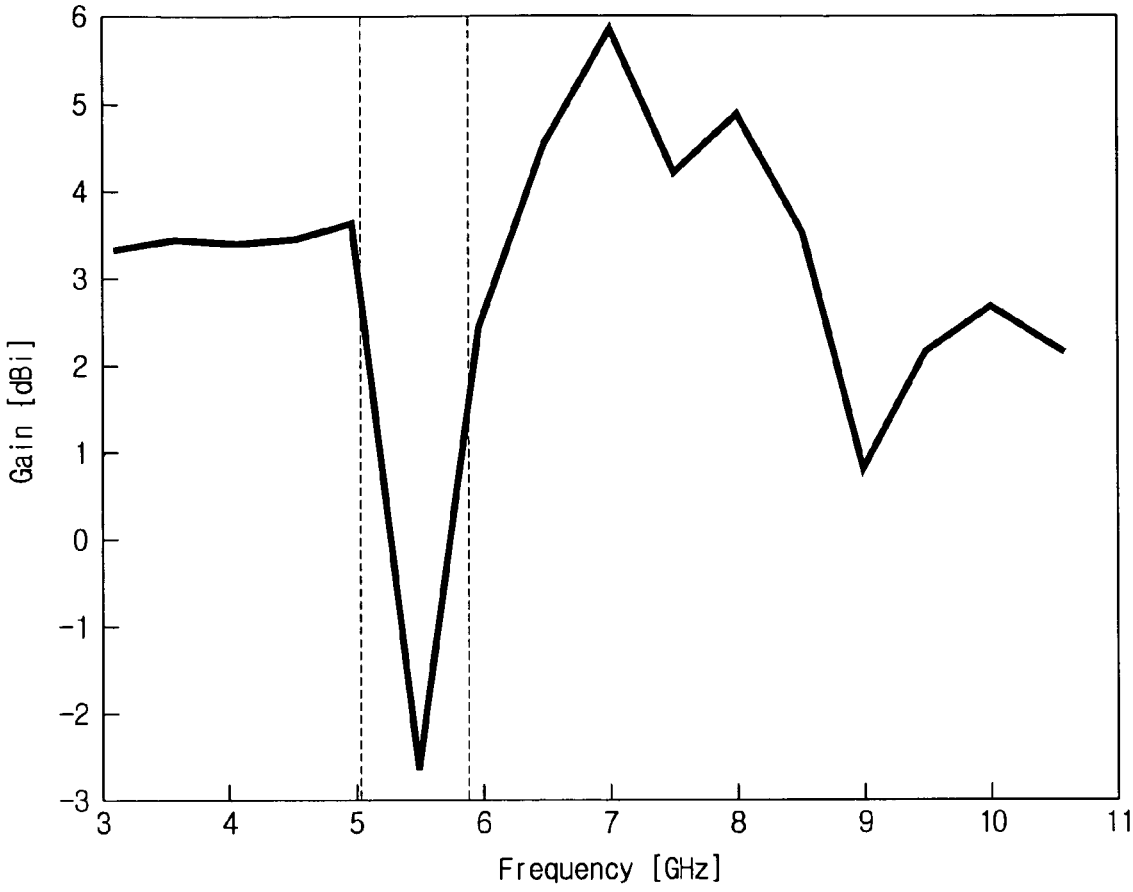
FIG. 3 is a graphical representation of gain of the UWB antenna of FIGS. 2A and 2B.
Figure 4:
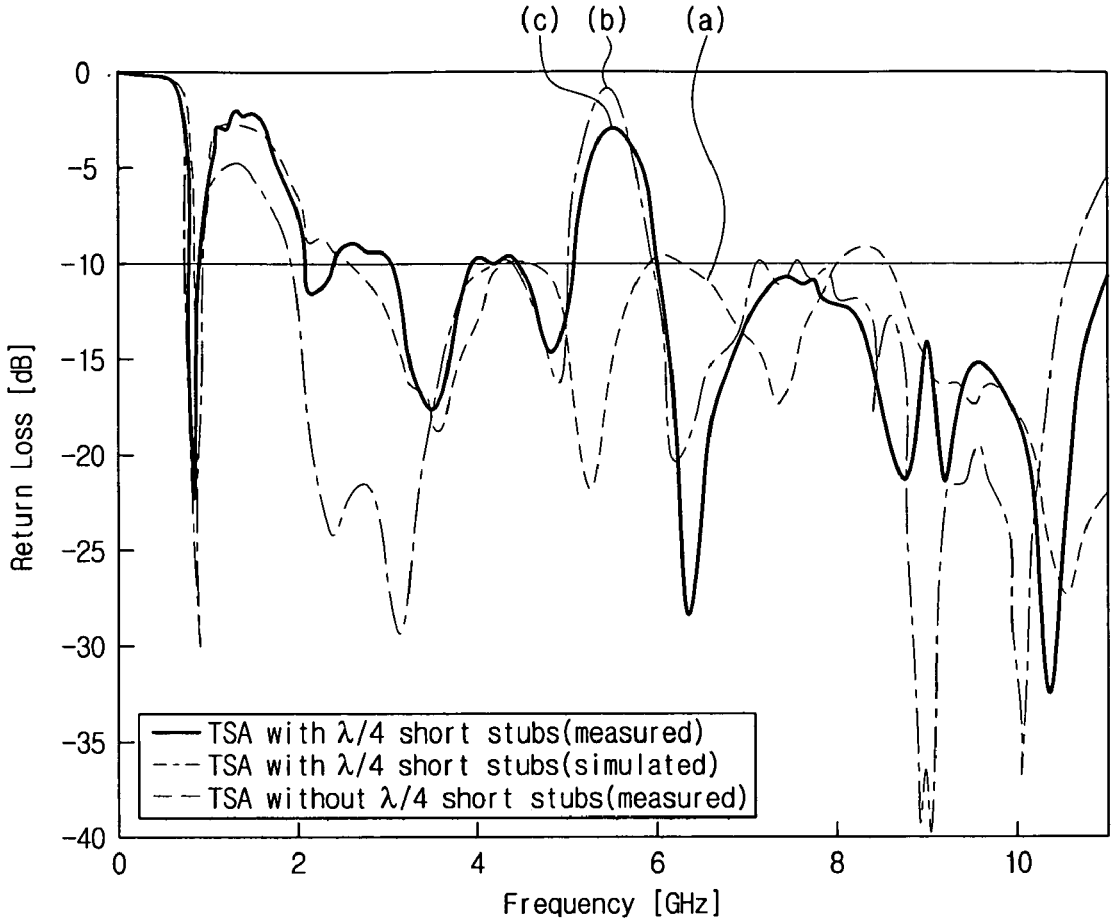
FIG. 4 is a graphical representation showing the relationship between the return loss and the frequency of the UWB antenna of FIGS. 2A and 2B.

FIGS. 3 and 4 show the results of experiments with respect to the respective areas of the UWB antenna 50, with W1, W2, L1, L2, $W_m$, $L_m$, $W_s$, and $L_s$ being set to 37 mm, 6.5 mm, 35 mm, 20 mm, 1.13 mm, 5.06 mm, 0.26 mm and 6.8 mm, respectively. W1, W2, L1, L2, $W_m$, $L_m$, $W_s$, and $L_s$ are shown in FIG. 2B.

FIG. 3 is a graphical representation of gain of the UWB antenna of FIG. 2. Referring to FIG. 3, gain drops to −2.7 [dBi] in 5 GHz~6 GHz. This is because the frequency signal of 5 GHz~6 GHz is blocked by the first and the second stubs 56 and 57.

FIG. 4 is a graphical representation showing the relationship between the return loss and the frequency of the UWB antenna of FIG. 2. The line (a) represents the return loss of the conventional UWB antenna 50 in the absence of the first and the second stubs 56 and 57. According to the line (a), return loss of −10 dB appears in 2 GHz~10 GHz. That is, all the UWB signals are received in 2 GHz~10 GHz.

The line (b) represents the return loss in 5 GHz~6 GHz according to the result of simulation with respect to the UWB antenna 50 having the first and the second stubs 56 and 57. According to line (b), return loss rises past −10 dB and approaches 0 dB.

The line (c) of FIG. 4 represents return loss according to the result of experiment which applies the UWB antenna 50 according to one embodiment of the present invention. According to the line (c), signals in 5 GHz~6 GHz are blocked.

The UWB antenna 50 uses the first and the second stubs 56 and 57 which are λ/4 in length, as a band stop filter of 5 GHz to perform the first band stop operation.

Figure 5:
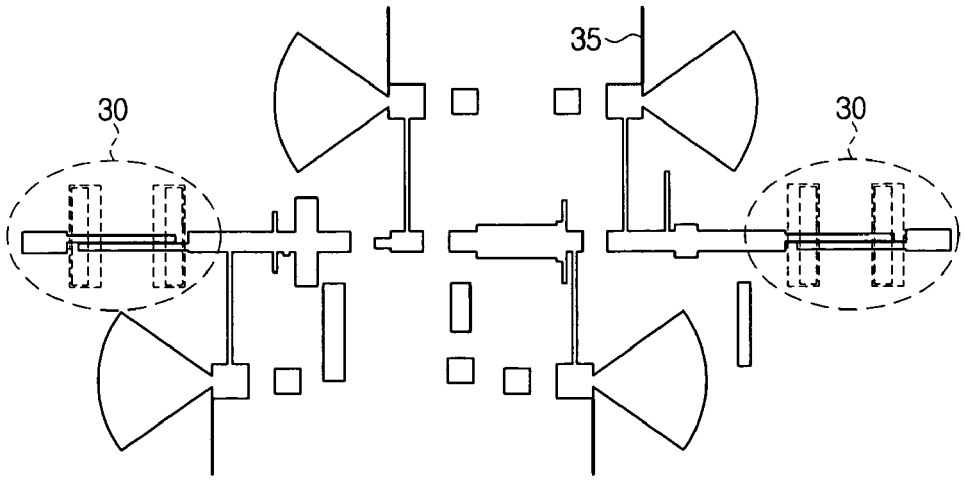
FIG. 5 shows an enlarged view of LNA (low noise amplifier) of FIG. 2A.

Meanwhile, the UWB antenna 50 has on its one side a LNA (low noise amplifier) 40 as shown in FIG. 5. The LNA 40 is an active circuit which receives external power supply and connected with four power lines 35. At the front and rear ends of the LNA 40, there are DC blocks 30 incorporating DGSs (defected ground structure) 20, to separate DC power supply and signals which are transmitted and received between the signal line 15 and the LNA 40.

The structure of the DC blocks 30 having the DGS will be explained below.

Figure 6:
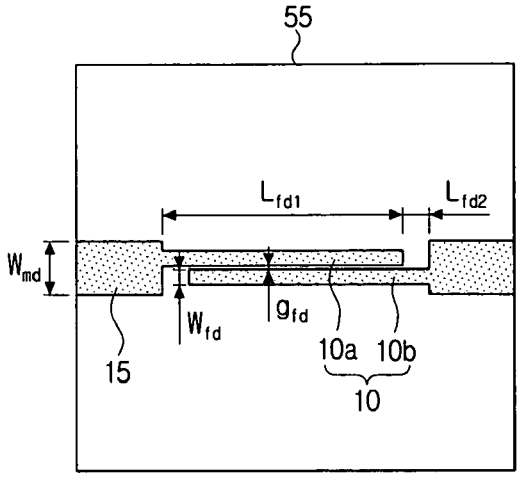
FIG. 6 is a plan view of coupled lines for use in a DC block of a general active circuit.
Figure 7:
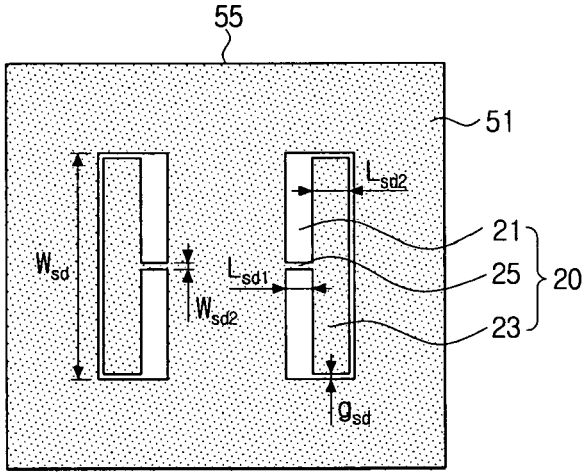
FIG. 7 is a plan view of DGSs (defected ground structure) corresponding to the coupled lines of DC block according to an embodiment of the present invention.

FIG. 6 is a plan view of coupled lines for use in DC block in a general active circuit, and FIG. 7 is a plan view of DGSs corresponding to the coupled lines of the DC block according to an embodiment of the present invention. The DGSs 20 are formed on the metal layer 51 of the substrate 55, and the coupled lines for use in DC block 30 are formed on the other side of the substrate 55 which has no metal layer 51.

The coupled lines 10 are formed as a micro-strip line, and include a first coupled line 10*a* extending from the signal line 15 of the other element, and a second coupled line 10*b* extending from the active circuit. The first and the second coupled lines 10*a* and 10*b* are parallel and at a predetermined distance from each other. Each of the first and the second coupled lines 10*a* and 10*b* are λ/4 in length.

A pair of DGSs 20 may be provided at a predetermined distance from each other, and each DGS 20 includes an etched area 21 formed by etching away a predetermined area of the metal layer 51, and a metal area 25 formed within the etched area 21. The metal area 25 is formed at the center of the etched area 21, and the etched area 21 surrounds the metal area 25 in a ring-shaped pattern.

Each of the DGSs 20 corresponds in position to the end of the corresponding coupled lines 10*a*, 10*b*, and lying across the width of the corresponding coupled lines 10*a*, 10*b*. FIG. 7 shows the square type etched area 21 of the DGS 20, and the square type metal area 25 which is smaller than the etched area 21. However, it should be understood by a practitioner that the etched area 21 may take any proper shapes. For example, the etched area 21 may be formed in the polygonal shapes such as a square, oval, circle or diamond, or even take the shape of a curved line. The metal area 25 may take the same configuration as the etched area 21.

A bridge 23 may be formed on a predetermined part of the edge of the metal area 25, to electrically connect the metal area 25 with the metal layer 51. The bridge 23 may be formed of the same metal material as the metal area 25. The bridge 23 may be formed longitudinally in the middle of the predetermined part of each DGS 20, and the DGSs 20 may be formed in a mirror image such that the bridge 23 of one DGS 20 lies adjacent to the bridge 23 the other DGS.

Due to the presence of the bridge 23, the etched area 21 is formed in the shape of a square ring with a predetermined part open. When extended, the length of the square ring shaped etched area 21 excluding the bridge 23 correspond to λ/2 of the stop band. Therefore, the length of the etched area 21 of the DGS 20 is same as the total length of the conventional DGS 20, but because the effect of bending the etched area 21 is obtained due to the presence of the metal area 25, the actual length of the DGS 20 can be reduced by more than a half.

The metal area 25 may be formed to one side of the etched area 21 so that the area with the bridge 23 can be wider than the area without it. However, the etched area 21 and the metal area 25 may be designed to various widths and lengths to adjust stop band and bandwidth.

Figure 8:
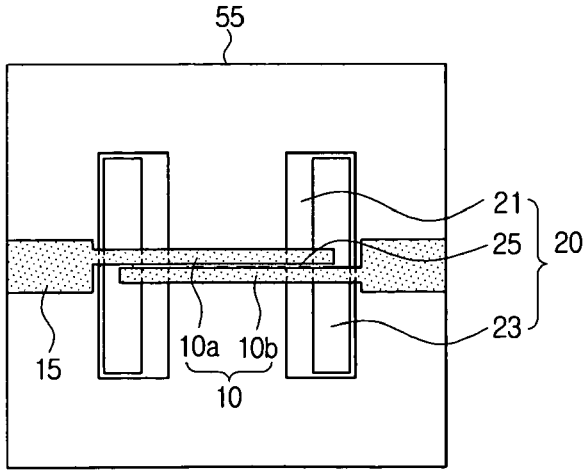
FIG. 8 is a perspective view of a DC block having a pair of coupled lines on one side, and a pair of DGSs on the other side of the substrate.

FIG. 8 is a perspective view of a DC block having a pair of coupled lines 10*a*, 10*b* on one side, and a pair of DGSs on the other side of the substrate 55.

Referring to FIG. 8, the DGSs are positioned on the ends of the coupled lines 10*a*, 10*b*, respectively. The bridges 23 are aligned with the gap between the coupled lines 10*a*, 10*b*.

By forming the coupled lines 10*a*, 10*b* for use in DC block 30 on one side of the substrate 55, and forming the DGSs 20 on the other side of the substrate 55, electromagnetic waves are focused around the respective coupled lines 10*a*, 10*b*. Accordingly, electromagnetic waves are interfered by the etched areas 21 of the DGSs 20, causing multi-interferences in the stop band. Because frequency delay effect can be obtained, the length of the coupled lines 10*a*, 10*b* is shortened and the distance between the coupled lines 10*a*, 10*b* is adjusted.

Figure 9:
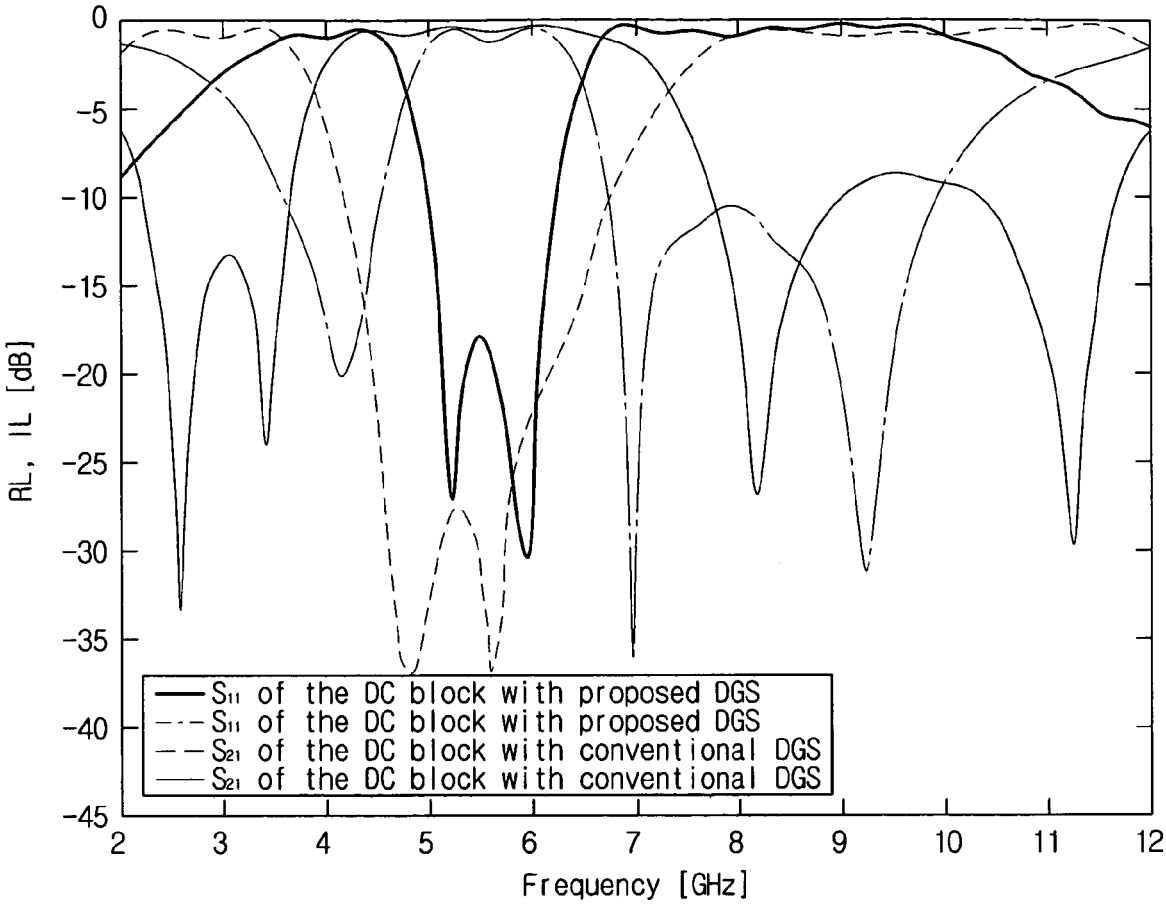
FIG. 9 is a graphical representation for comparing characteristics $S_{11}$, $S_{12}$ between the DC block incorporating the DGS of FIG. 8 and the DC block incorporating a conventional DGS.

FIG. 9 is a graphical representation showing comparison of characteristics $S_{11}$, $S_{12}$ between the DC block incorporating the DGS of FIG. 8 and the DC block incorporating a conventional DGS. More specifically, the characteristics $S_{11}$, $S_{12}$ are obtained when the coupled lines 10*a*, 10*b* for DC block 30 as shown in FIG. 6, and the characteristics $S_{11}$, $S_{12}$ of the DGSs 20 of FIG. 7 are sized as follows:

The substrate 55 is 0.600 mm in thickness, and has dielectric constant $\in_r$ of 4.5. The signal line 15 has the width $W_{md}$ of 1.130 mm, and each of the coupled lines 10*a*, 10*b* has the width $W_{fd}$ of 0.300 mm. Each of the coupled line. 10*a*, 10*b* has the length $L_{fd1}$ of 5.895 mm. The gap $L_{fd2}$ between the coupled lines 10*a*, 10*b* and the signal line 15 is 0.705 mm, and the gap $L_{fd}$ between the coupled lines 10*a*, 10*b* is 0.150 mm. The etched area 21 of each of the DGSs 20 has the width $W_{sd}$ of 5.650 mm, and the length $L_{sd2}$ of the metal area 25 is 0.730 mm. Each of the bridges 23 has a width $W_{sd2}$ of 0.150 mm, and each of the etched areas 21 with the bridge 23 has the width $L_{sd1}$ of 0.730 mm, and each of the etched areas 21 without the bridge 23 has the width $g_{sd}$ of 0.150 mm. The gap $g_{fd}$ between the coupled lines 10*a*, 10*b* is equal to the width $W_{sd2}$ of the bridges 23 of the DGS 20.

As a result of designing the DC block 30 as above and measuring the bandwidths, it was confirmed that the DC block 30 employing the DGSs 20 according to the embodiment of the present invention has a narrower bandwidth in the characteristic $S_{11}$ than the DC block 30 employing the conventional DGSs 20. Likewise, the DC block 30 employing the DGSs 20 according to the embodiment of the present invention has a narrower bandwidth in the characteristic $S_{21}$ than the DC block 30 having the conventional DGSs 20. Accordingly, the DC block 30 employing the DGSs 20 according to the embodiment of the present invention can specify the stop band more accurately. As it can be seen from the characteristic $S_{11}$ of the DC block 30 having the DGSs 20 according to the embodiment of the present invention, the WLAN communication band, which needs be stopped in the UWB communication, is notched in 5.15 GHz~5.825 GHz. Accordingly, the DC block 30 employing the DGSs 20 according to the embodiment of the present invention is very effective in removing the WLAN signals in the UWB communication.

Figure 10:
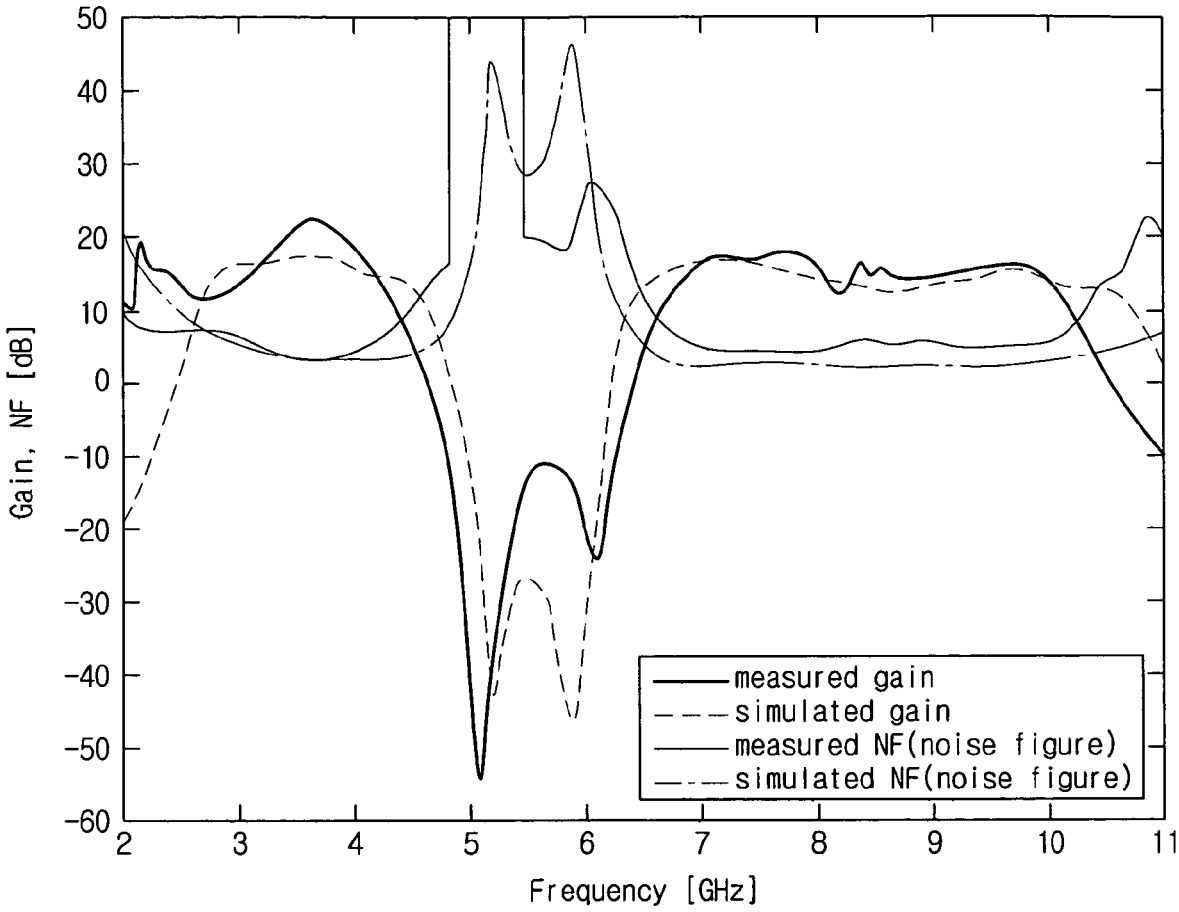
FIG. 10 is a graphical representation showing gain and NF of the UWB LNA of FIG. 5.

FIG. 10 is a graphical representation of the gain and NF (noise figure) of the UWB LNA 40 of FIG. 5. Referring to FIG. 10, the simulated gain and NF are very close to the real, measured gain and NF, and thus the present invention can be applied to the UWB LNA 40.

The measured gain is notched as much as −30 dB in 5~6 GHz, that is, it is notched in the frequency band of the WLAN.

Therefore, WLAN signals can be blocked during the use of UWB LNA 40. Additionally, the maximum gain and power are reduced more than −55 dB when the input signal has power approximately of 10 dB, which means that the power of the input signal is restrained by 68 dB at the maximum. Considering that the difference between UWB and WLAN is 70 dB, it can be concluded that no additional band stop filter (BSF) is necessary.

Figure 11:
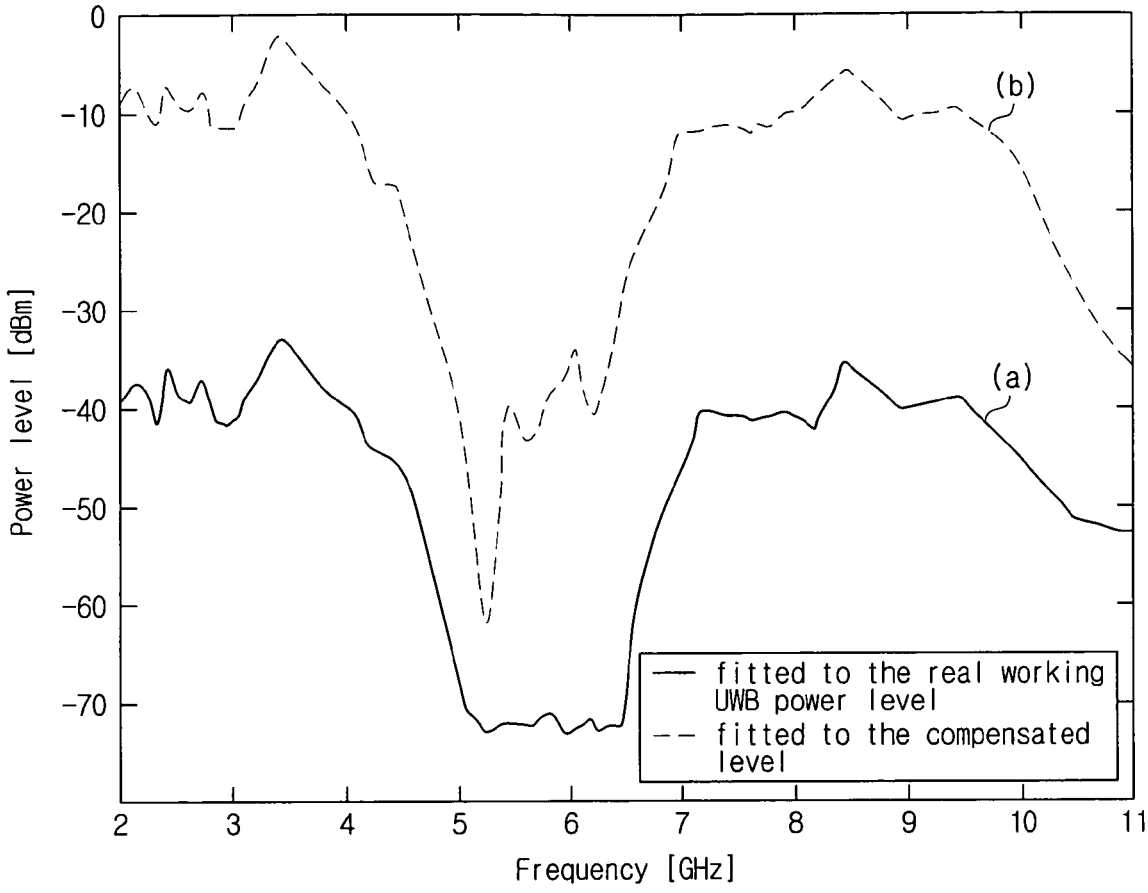
FIG. 11 is a graphical representation showing the power level of the signal which is received and processed at the UWB receiver system of FIG. 2B.

FIG. 11 is a graphical representation of power levels of the signals received and processed in the UWB receiver system of FIG. 2B.

Referring to FIG. 11, the line (a) represents the result of receiving the signal of power −41.3 dBm/MHz, which is the usual power level of the real working UWB receiver system. The power reduction is not so great because −72 dB is the lowest level of noise in the system band.

Accordingly, the power level was increased approximately by 30 dB and measured to find out the stop band characteristics of the proposed structure. The line (b) shows that the power of the stop band falls to −63.2 dB. This means that the power reduction of maximum 71 dB can be obtained in the band of the UWB system, and that it is enough to reduce 70 dB, which is the power of the WLAN band.

Meanwhile, as the UW antenna 50 has a directional radiation pattern, it is applicable to WPAN, GPR, or IrDA which needs point-to-point wireless data transmission at high speed.

As explained above with reference to a few exemplary embodiments of the present invention, the UWB receiver system uses a pair of stubs which are λ/4 in length to make UWB antenna of stop band characteristics, and uses the LNA having DC block with DGSs to adjust bandwidth and stop band. Because the stop band operation is performed by two stages using UWB antenna and LNA, power in the WLAN frequency band 5 GHz can be completely removed. As a result, efficiency of the UWB receiver system is improved and interference by WLAN signals is removed.

Additionally, the UWB receiver system according to the present invention can omit passive element such as BPF. Therefore, structure is simple, size is compact, and design and manufacture are easy.

The above description is illustrative and not restrictive. Many variations of the invention will become apparent to those of skill in the art upon review of this disclosure. The scope of the invention should, therefore, be determined not with reference to the above description, but instead should be determined with reference to the appended claims along with their full scope of equivalents.

What is claimed is:

1. An ultra wide band receiver system comprising:

a ultra wide band antenna and an active circuit, the ultra wide band antenna including a power feed operable to receive electromagnetic energy, and the ultra wide band antenna further including a radiator operable to be excited by the electromagnetic energy fed through the power feed to radiate an electromagnetic wave, the radiator having a metal layer; and the active circuit including a pair of parallel coupled lines arranged on a first side of the radiator, the pair of parallel coupled lines operable to block DC current, and the active circuit further including at least one defected ground structure formed on a second side, opposite to the first side, of the radiator, wherein the defected ground structure is formed on an etched out part of the metal layer attached to the radiator.

2. The ultra wide band receiver system of claim 1, wherein the radiator includes:

a substrate, the metal layer being bonded onto the substrate; and a taper type slot formed on a removed part of one side of the metal layer, the taper type gradually widening in a radiating direction of the electromagnetic wave, the taper type dividing the metal layer into two parts.

3. The ultra wide band receiver system of claim 2, further including a stub operable to block signal transmission and reception at a frequency band, the stub being notched on a side of the metal area adjoining the taper type slot, the notch being in a direction substantially parallel to an electric field of the electromagnetic wave.

4. The ultra wide band receiver system of claim 3, wherein the stub comprises a first part and a second part, the first and the second part being open on one end toward the taper type slot, the first and the second stubs having a length of λ/4 of a center frequency signal of the frequency band.

5. The ultra wide band receiver system of claim 2, wherein the power feed further includes:

a first power feed part formed on a lower surface of the substrate, the first power feed part operable to receive a supply of the electromagnetic energy; and a second power feed part having an etched area at a leading end of the taper type, the second power feed being operable to couple the electromagnetic energy.

6. The ultra wide band receiver system of claim 5, wherein the first and the second power feeds have a plurality of radially-arranged arms.

7. The ultra wide band receiver system of claim 1, wherein the at least one defected ground structure further includes an etched area in a part of the metal layer, and a metal area formed within the etched area.

8. The ultra wide band receiver system of claim 1, wherein a pair of defected ground structures are provided to correspond in position to ends of the pair of coupled lines, respectively, the defected ground structures being formed across a width of the first and the second coupled lines, respectively.

9. The ultra wide band receiver system of claim 7, wherein the etched area is formed around the metal area.

10. The ultra wide band receiver system of claim 7, wherein a bridge is formed on one side of the metal area, the bridge being operable to electrically connect the metal area and the metal layer.

11. The ultra wide band receiver system of claim 10, wherein the bridge is formed longitudinally in the middle of one side of each of the defected ground structures.

12. The ultra wide band receiver system of claim 10, wherein the bridge corresponding to one defected ground structure is arranged to face the bridge corresponding to another defected ground structure.

13. The ultra wide band receiver system of claim 10, wherein the first and the second coupled lines of the pair of coupled lines have a gap from each other, and the bridge corresponding to each of the defected ground structures is aligned with the gap.

14. The ultra wide band receiver system of claim 10, wherein the gap is equal to a width of the bridge.

15. The ultra wide band receiver system of claim 10, wherein the length of the etched area extended but excluding the bridge corresponds to λ/2 of the stop band.

16. The ultra wide band receiver system of claim 7, wherein the etched area has at least one of rectangle, square, ellipse, circle, diamond, zigzag, and spiral shapes.

17. The ultra wide band receiver system of claim 7, wherein the metal area has a same shape as the etched area.

18. The ultra wide band receiver system of claim 7, wherein widths and lengths of the etched area and the metal area are determined based on the stop band and the bandwidth.

19. The ultra wide band receiver system of claim 10, wherein the metal area is formed on a side other than a side corresponding to the bridge, wherein a side having the bridge is wider than a side without the bridge.

20. The ultra wide band receiver system of claim 1, wherein the active circuit comprises a low noise amplifier.

21. An active circuit comprising:

a pair of coupled lines parallel arranged on one side of a dielectric body, the coupled lines operable to block DC current; and at least one defected ground structure formed on an opposite side of the dielectric body corresponding to the coupled lines, and the defected ground structure including an etched area on a ground surface attached to the dielectric body, and a metal area being formed within the etched area.

22. An ultra wide band receiver system comprising:

a ultra wide band antenna and an active circuit, the ultra wide band antenna including a power feed operable to receive electromagnetic energy, and the ultra wide band antenna further including a radiator operable to be excited by the electromagnetic energy fed through the power feed to radiate a predetermined electromagnetic wave, the radiator having a metal layer; and the active circuit further including:

a pair of coupled lines parallel arranged on one side of the radiator, the coupled lines operable to block DC current; and at least one defected ground structure formed on an opposite side of the radiator corresponding to the coupled lines, and the defected ground structure including an etched area on a ground surface attached to the radiator, and a metal area being formed within the etched area.

23. An ultra wide band receiver system comprising:

an ultra wide band antenna comprising, a first power feed operable to receive supply of electromagnetic energy, a radiating body operable to be excited by the electromagnetic energy fed from the first power feed and operable to radiate an electromagnetic wave, and at least one stub formed on the radiator body and substantially parallel to an electric field generated by the electromagnetic wave, the at least one stub operable to block transmission and reception of a signal and an active circuit further including:

a pair of coupled lines parallel arranged on one side of the radiating body, the coupled lines operable to block DC current; and at least one defected ground structure formed on an opposite side of the radiating body corresponding to the coupled lines, and the defected ground structure including an etched area on a ground surface attached to the radiating body, and a metal area being formed within the etched area.

* * * * *